US007926210B2

(12) United States Patent
Versteeg

(10) Patent No.: US 7,926,210 B2
(45) Date of Patent: Apr. 19, 2011

(54) APPARATUS AND METHOD FOR BAGGAGE CHECK AND PROMOTIONAL ADVERTISEMENT

(75) Inventor: Freddy Versteeg, Salt Lake City, UT (US)

(73) Assignee: Freddy Versteeg, Sandy, UT (US)

( * ) Notice: Subject to any disclaimer, the term of this patent is extended or adjusted under 35 U.S.C. 154(b) by 0 days.

(21) Appl. No.: 12/069,183

(22) Filed: Feb. 6, 2008

(65) Prior Publication Data

US 2009/0223099 A1 Sep. 10, 2009

Related U.S. Application Data

(60) Provisional application No. 60/899,775, filed on Feb. 6, 2007, provisional application No. 61/001,776, filed on Nov. 2, 2007.

(51) Int. Cl.
*G09F 3/20* (2006.01)

(52) U.S. Cl. ..... 40/6; 40/675; 283/80

(58) Field of Classification Search ..... 40/6; 283/80, 283/100, 94

See application file for complete search history.

(56) References Cited

U.S. PATENT DOCUMENTS

| | | | | |
|---|---|---|---|---|
| 4,978,144 | A * | 12/1990 | Schmidt et al. | 283/70 |
| 5,395,667 | A * | 3/1995 | Ohno et al. | 428/41.3 |
| 6,179,337 | B1 * | 1/2001 | Zumberge | 283/81 |
| 6,623,039 | B2 * | 9/2003 | Thompson et al. | 283/61 |
| 6,898,880 | B2 * | 5/2005 | Best et al. | 40/299.01 |
| 2005/0081411 | A1 * | 4/2005 | Becker | 40/6 |
| 2006/0026871 | A1 * | 2/2006 | Alexander et al. | 40/6 |
| 2008/0028655 | A1 * | 2/2008 | Riley | 40/633 |
| 2009/0309352 | A1 * | 12/2009 | Walker et al. | 283/100 |

* cited by examiner

*Primary Examiner* — Joanne Silbermann
*Assistant Examiner* — Kristina Staley
(74) *Attorney, Agent, or Firm* — Steven L. Nichols; Van Cott, Bagley, Cornwall & McCarthy P.C.

(57) ABSTRACT

An apparatus and method for identifying luggage and promotional advertising for use by hotels, casinos and the like are disclosed. The apparatus includes a tag having a first side having a scratch surface covering promotional material and a second side having a portion for printing identifying information. The tag and the promotional material can be used by a hotel, casino or the like to encourage guests to attend shows or dine at restaurants being promoted.

12 Claims, 7 Drawing Sheets

APPARATUS AND METHOD FOR BAGGAGE CHECK AND PROMOTIONAL ADVERTISEMENT

RELATED APPLICATIONS

This application claims priority to U.S. Provisional Application, entitled "Apparatus and Method for a Baggage Check and Promotional Advertisement," filed Feb. 6, 2007, Ser. No. 60/899,775, and to U.S. Provisional Application, entitled "Apparatus and Method for Baggage Check and Promotional Advertisement," filed Nov. 2, 2007, Ser. No. 61/001,776.

TECHNICAL FIELD OF THE INVENTION

The present invention relates to a luggage identification tag and system for promotional advertising for use by hotels, casinos and the like.

BACKGROUND OF THE INVENTION

Hotels, casinos and the like go to various efforts to promote shows or restaurants or other forms of entertainment owned, produced or operated by the hotels or casinos or in partnership with other hotels or casinos or related organizations. Oftentimes, substantial amounts of money are expended toward these efforts with the ultimate goal being to coax or encourage consumers to a particular destination either within or nearby the hotel or casino. The present invention provides a means to accomplish this objective simply and inexpensively.

SUMMARY OF THE INVENTION

A luggage tag and method for promotional advertisement is disclosed. The luggage tag includes a substrate having first and second sides, and information printed thereon for identification of luggage and promotional advertisement.

DETAILED DESCRIPTION OF THE INVENTION

Figure 1:
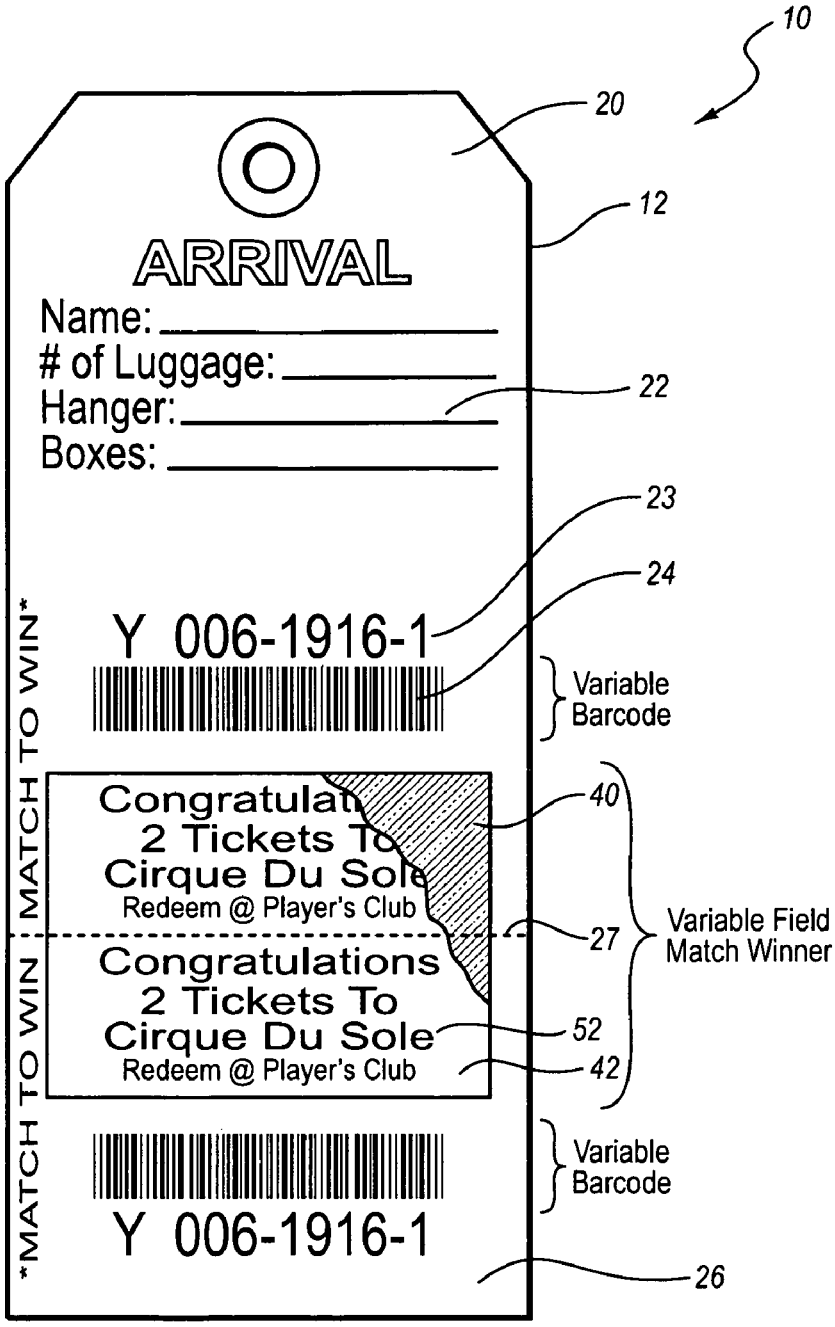
FIG. 1 depicts a first side of an embodiment of a luggage tag system of the present invention, having luggage ownership identifying information or space therefore and scratch-surface panels for promotional advertising.
Figure 2:
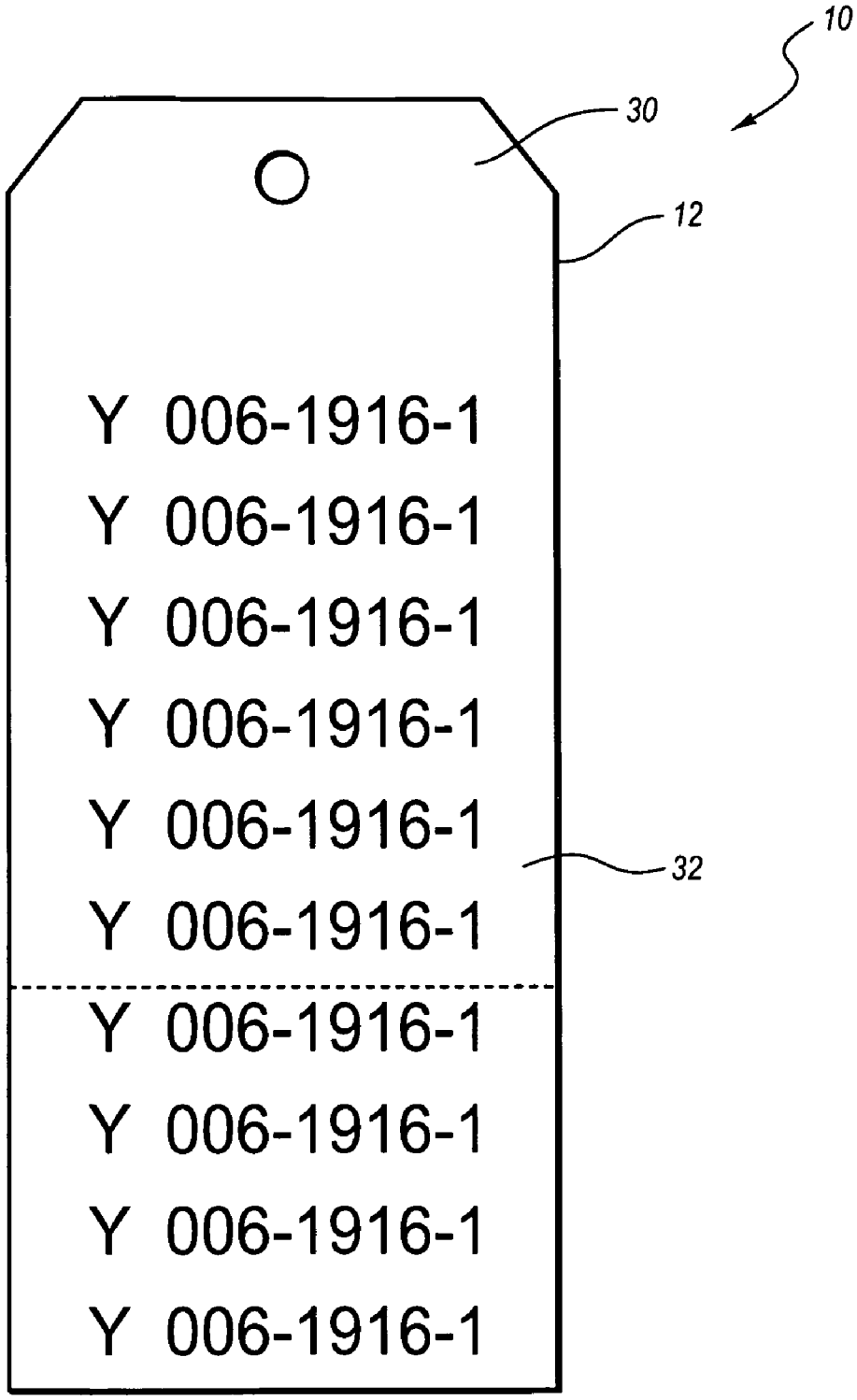
FIG. 2 depicts a second side of an embodiment of a luggage tag system of the present invention having further luggage ownership identifying information printed thereon.

This invention concerns apparatus and methods for use by hotels, casinos and the like to identify ownership of luggage and to provide promotional advertisement. Referring, for example, to FIGS. 1 and 2, a luggage tag 10 of the present invention is illustrated. The luggage tag 10 includes a generally flat substrate 12 having a first surface 20 and a second surface 30. Generally speaking, the first surface 20 comprises a front side of the flat substrate 12 while the second surface 30 comprises a back or opposite side of the flat substrate 12. The flat substrate 12 of the luggage tag 10 can be constructed using any suitable material, such as, for example, plastic, paper, vinyl or cardboard, or a combination thereof.

Referring particularly to FIG. 1, the first surface 20 includes a first portion 22 for printing ownership identifying information. The ownership identifying information includes generally the owner's name, the number of pieces of luggage and any additional information that is helpful in tracking or delivering the luggage—e.g., the room number of the owner while a guest at a hotel or casino. An identification serial number 23 and, if desired, a corresponding variable barcode 24, is printed on the luggage tag for further identifying purposes.

The first surface 20 further includes a second portion 26 that is removably connected to the first portion 22 through a perforated segment 27 allowing the first section 22 and second section 26 to be separated. A first scratch surface 40 is provided on the first portion 22 and a second scratch surface 42 is provided on the second portion 26. The first 40 and second 42 scratch surfaces cover printed information concerning a promotional advertisement, and serve to keep the information hidden prior to the scratch surfaces being scratched away by a user's fingernail or coin or the like. Referring to FIG. 2, the second surface 30 includes one or more identifying labels 32. The identifying labels 32 are preferably kiss-cut and removably attached to the second surface 30.

In one embodiment, a method for identifying ownership of luggage and providing a promotional advertisement is disclosed. Specifically, upon arrival by a guest at a hotel or casino, a luggage tag 10 of the present invention is obtained by a hotel or casino employee. Information concerning the name of the guest and the number of pieces of luggage is noted on the first portion 22 of the luggage tag 10, along with the room number or cell phone number or other pertinent identifying information. Luggage identifying labels 32 are then detached from the second surface 30 of the luggage tag 10 and removeably attached to the individual pieces of luggage, which are thereafter transported to the guest's room by a bellhop or other hotel or casino employee. The second portion 26 of the luggage tag is then separated from the first portion 22 by tearing along the perforated segment 27. The second portion 26 is provided to the guest and the first portion 22 is provided to the bellhop.

Following arrival and check-in of luggage, the guest may proceed to his or her room or where they might otherwise desire. At the same time or thereafter, the luggage is transported to the guest's room and the first portion 22 of the luggage tag 10 is left with the delivered luggage or at a suitable location where the guest may locate the first portion 22. The guest may then scratch away the first 40 and second 42 scratch-surface portions, thereby revealing or exposing first 50 and second 52 printed promotional materials previously blocked from view by the scratch-surfaces. In an embodiment, if both the first 50 and second 52 printed promotional materials match, then the guest wins whatever is being advertised by the first 50 and second 52 printed promotional material—e.g., a ticket or tickets to a show or dinner at a restaurant.

Figure 3:
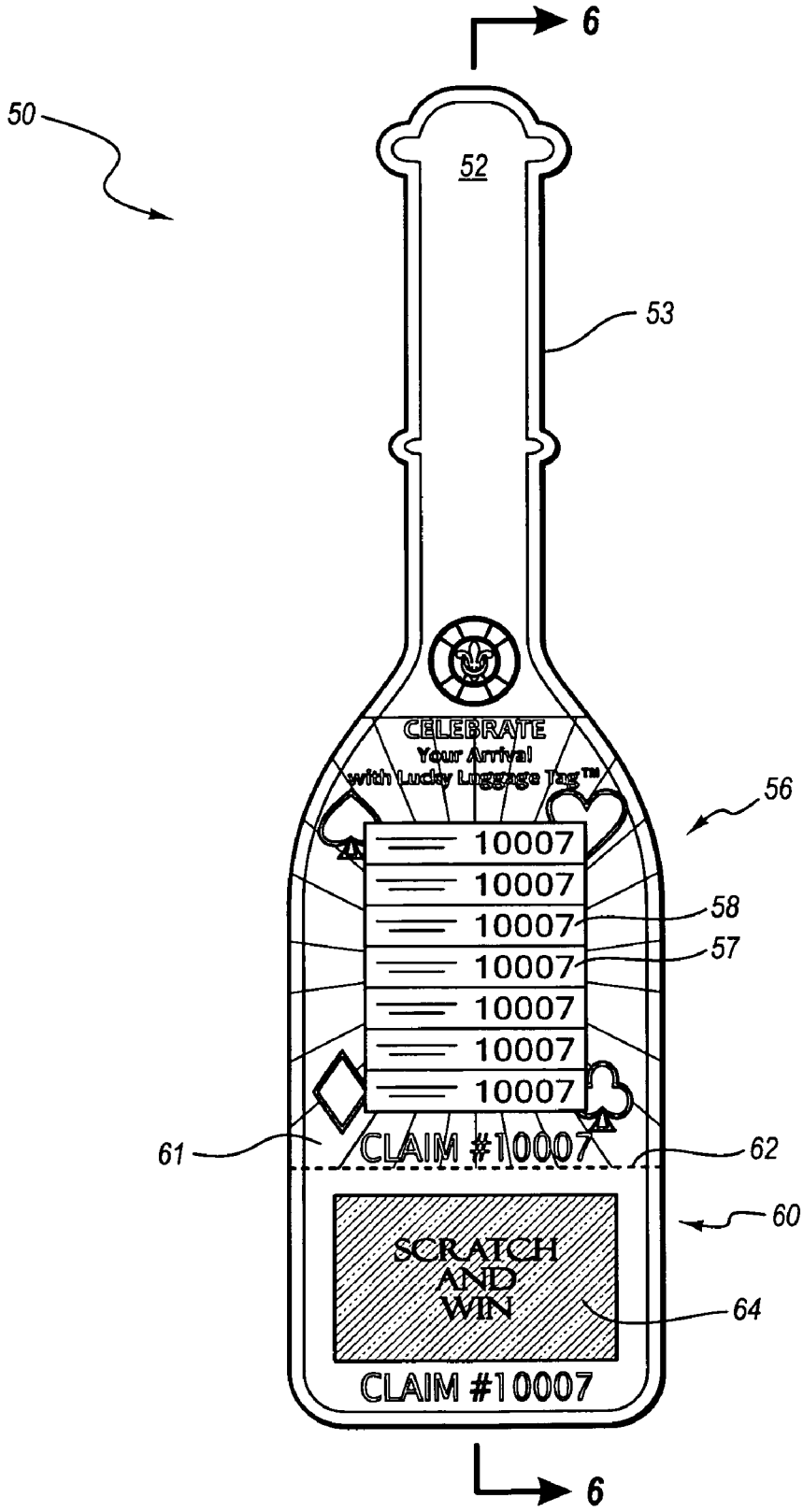
FIG. 3 depicts a first side of a further embodiment of a luggage tag system of the present invention having a scratch surface.
Figure 4:
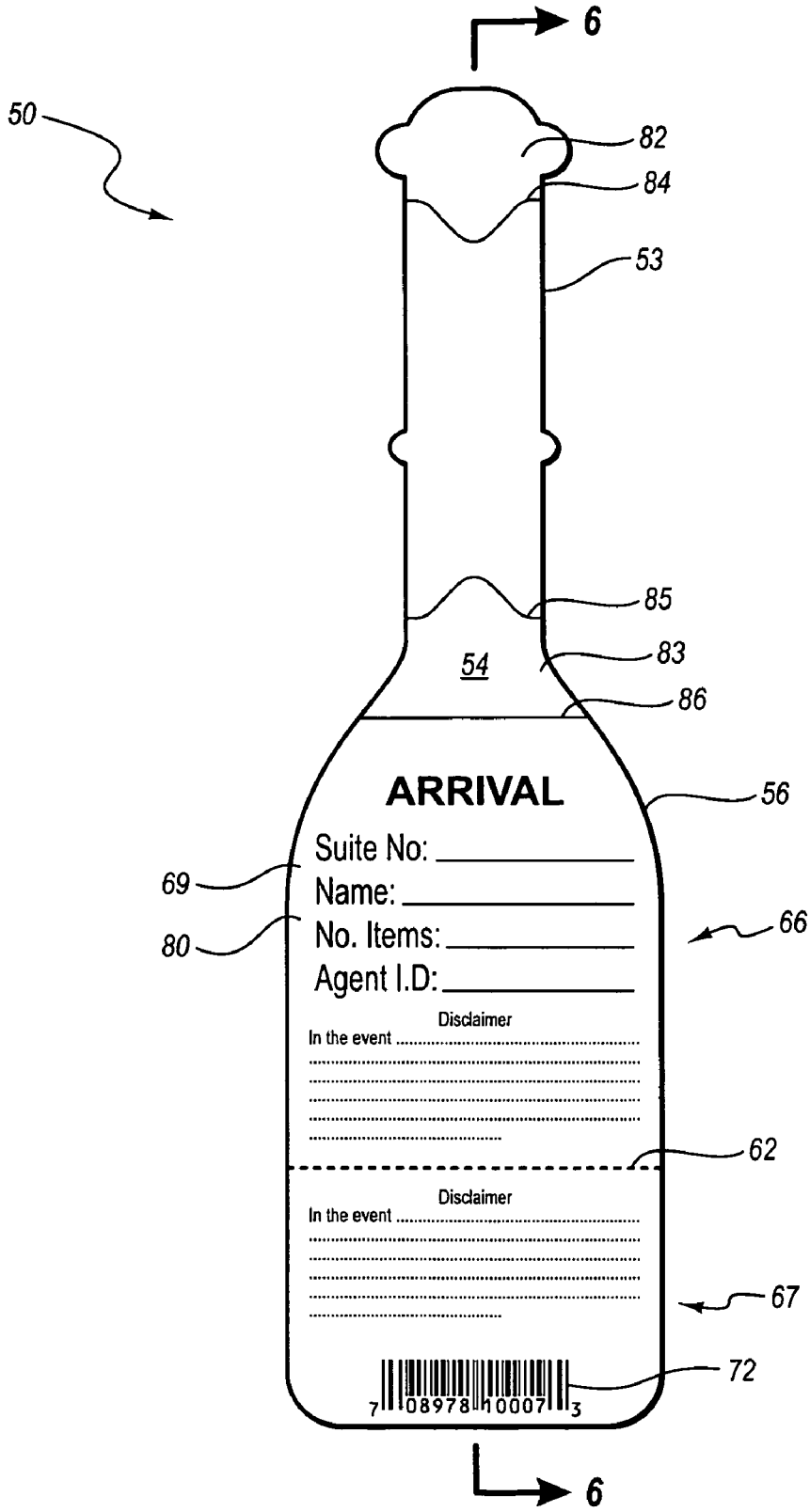
FIG. 4 depicts a second side of the embodiment disclosed in FIG. 3 having a portion for providing luggage ownership information thereon.

Referring now to FIGS. 3 and 4, a further embodiment of the present invention is disclosed. Specifically, a luggage tag 50 includes a substrate 53 having a first surface 52 and a second surface 54. Generally speaking, the first surface 52 comprises a front side of the substrate 53 while the second surface 54 comprises a back or opposite side of the substrate 53. The substrate 53 of the luggage tag 50 can be constructed using any suitable material, such as, for example, plastic, paper, vinyl or cardboard, or a combination thereof.

Referring particularly to FIG. 3, the first surface 52 includes a first portion 56 and a second portion 60. The first portion 56 and the second portion 60 are separable by a perforated segment 62. The first portion 56 of the first surface 52 includes space for one or more identifying labels 58. Each identifying label 58 preferably includes a unique identifying serial number 57 (e.g., "10007" as illustrated) and, if desired, a corresponding barcode (not illustrated) for identifying purposes. Alternatively, each identifying label may include simply a bar code. The identifying labels 58 are preferably kiss-cut and removably attached to the first surface 52. The unique identifying serial number 57 is, preferably, also printed elsewhere on the first surface 52 at a location—e.g., location "61"—where it does not interfere with the identifying labels 58. The first portion 56 also includes space for a scratch surface 64. The scratch surface 64 covers information printed underneath thereof on the first surface 56 concerning a promotional advertisement or solicitation, and serves to keep the information hidden prior to the scratch surface being scratched away by a user's fingernail or coin or the like.

Referring to FIG. 4, the second surface 54 includes a first portion 66 and a second portion 67. The first portion 66 and the second portion 67 are separable by a perforated segment, preferably the same perforated segment 62 referred to above. The first portion 66 of the second surface 54 includes space for printing various identifying information including, for example, ownership identifying information 80. The ownership identifying information 80 includes generally the owner's name, the number of pieces of luggage and any additional information that is helpful in tracking or delivering the luggage—e.g., the room number of the owner while a guest at a hotel or casino. The ownership identifying information 80 is printed at a suitable location—e.g., location "69"—on the first portion 66 of the second surface 54. The first portion 66 of the second surface 54 further includes space for printing additional information—e.g., a disclaimer—relating to the promotional advertisement appearing under the scratch surface 64 located on the second portion 60 of the first surface 52 of the luggage tag 50. The same additional information may, if desired, be printed on the second portion 67 of the second surface 54. The unique identifying serial number 57 and, if desired, a corresponding barcode 72, is also be printed on the second portion 67 of the second surface 54 for further identifying purposes. Preferably, the first portion 66 and the second portion 67 of the second surface 54 are separable using the perforated segment 62—i.e., the same perforated segment used to separate the first portion 56 and the second portion 60 of the first surface 52.

Figure 5:
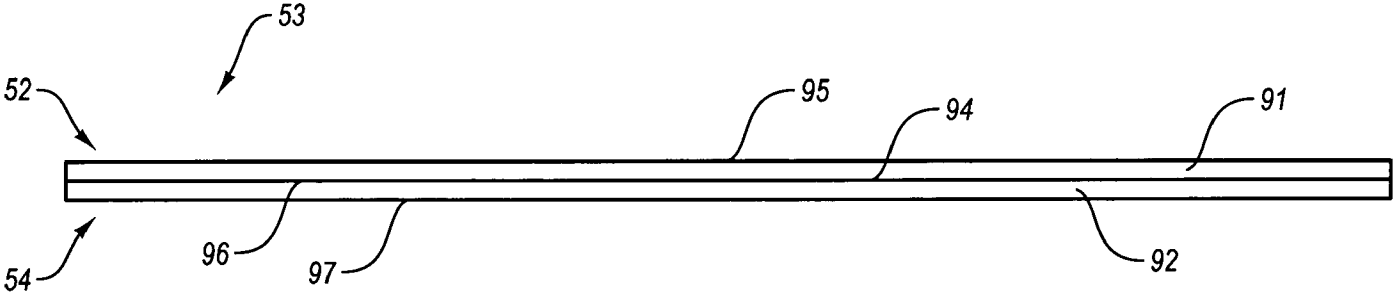
FIG. 5 depicts a cross sectional view of the two layer flexible vinyl substrate used in making the embodiment of the present invention illustrated in FIGS. 3 and 4.
Figure 6:
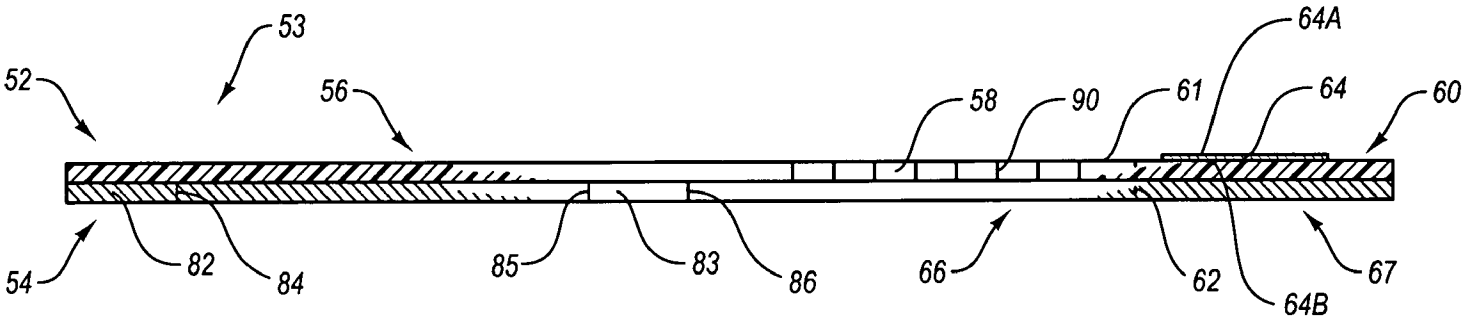
FIG. 6 depicts a further cross sectional view of the two layer flexible vinyl substrate used in making the embodiment of the present invention illustrated in FIGS. 3 and 4 with the inclusion of kiss-cuts and scratch layer.

Referring now to FIGS. 5 and 6, further details of an embodiment similar to that just discussed are disclosed. Referring to FIG. 5, for example, the flat substrate 53 is constructed from a substrate stock having, in cross section, a first layer 91 and a second layer 92. The first layer 91 includes a vinyl sheet having an adhesive underside 94 and a topside 95 suitable for lithographic printing. The second layer 92 includes a vinyl sheet having an adhesive receiving underside 96 and a topside 97 suitable for lithographic printing. Referring also to FIGS. 3 and 4, the first surface 52 of the flat substrate 53 corresponds to the topside 95 of the first layer 91 and the second surface 54 of the flat substrate 53 corresponds to the topside 97 of the second layer 92. A suitable dual-layer flexible vinyl substrate as described herein and above may be purchased from Fasson®. The substrate may be purchased on either rolls or sheets suitable for use with lithographic processing techniques.

Referring now to FIGS. 5 and 6 and to FIGS. 3 and 4 where appropriate, the first layer 91 includes the first portion 56 and the second portion 60 of the first surface 52. The topside 95 of the first layer 91 includes a suitable space at the first portion 56—e.g., location "61"—for printing the unique identifying serial number 57 (e.g., "10007" as illustrated). The first layer 91 further includes one or more identifying labels 58. The identifying labels 58 each include the unique identifying serial number 57 or bar code (not illustrated) printed on the topside 95. The identifying labels 58 are preferably sectioned by kiss-cuts 90 extending through the first layer 91 and removably attached to the second layer 92 by the adhesive underside 94 of the first layer 91. The first portion 56 and the second portion 60 of the first layer 91 are separable through the perforation segment 62. The scratch surface 64 is provided on the topside 95 of the first layer 91 at a suitable space at the second portion 60. The unique identifying serial number 57 is, preferably, also printed on the on the topside 95 of the first layer 91 at the second portion 60 in an area not obscured by the scratch surface 64. In one embodiment, the scratch surface 64 comprises a grey ultraviolet layer that may be applied using standard techniques know to those having skill in the art. In a further embodiment, the scratch surface 64 comprises a grey ultraviolet layer 64A applied on top of a previously applied clear ultraviolet layer 64B. The clear ultraviolet layer 64B serves to protect the promotional advertisement, solicitation or other printed information from being scratched away during the process of removing the scratch surface 64 by a user's fingernail or coin or the like.

Referring still to FIGS. 3-6, the second layer 92 includes the first portion 66 and the second portion 67 of the second surface 54. The topside 97 of the second layer 92 includes a suitable space at the first portion 66—e.g., location "69"—for printing the ownership identifying information 80 and the disclaimer relating to the promotional advertisement appearing under the scratch surface 64. The first portion 66 and the second portion 67 of the second layer 92 are separable through the perforation segment 62. The topside 97 of the second layer 92 at the second portion 67 includes space for printing additional information—e.g., the disclaimer referred to above—and, in addition, the unique identifying serial number 57. If desired, a barcode 72 corresponding to the unique identifying serial number 57 is also printed on the topside 97 of the second layer 92 at the second portion 67 for identifying purposes. The second layer 92 further includes first 82 and second 83 removable portions that are defined and sectioned by first 84, second 85 and third 86 kiss-cut segments extending through the layer. The first 82 and second 83 removable portions are removed from the second layer 92 thereby exposing corresponding portions of the adhesive underside 94 of the first layer 91 that can be secured to one another so as to form a loop securable about a luggage handle or the like.

Figure 7:
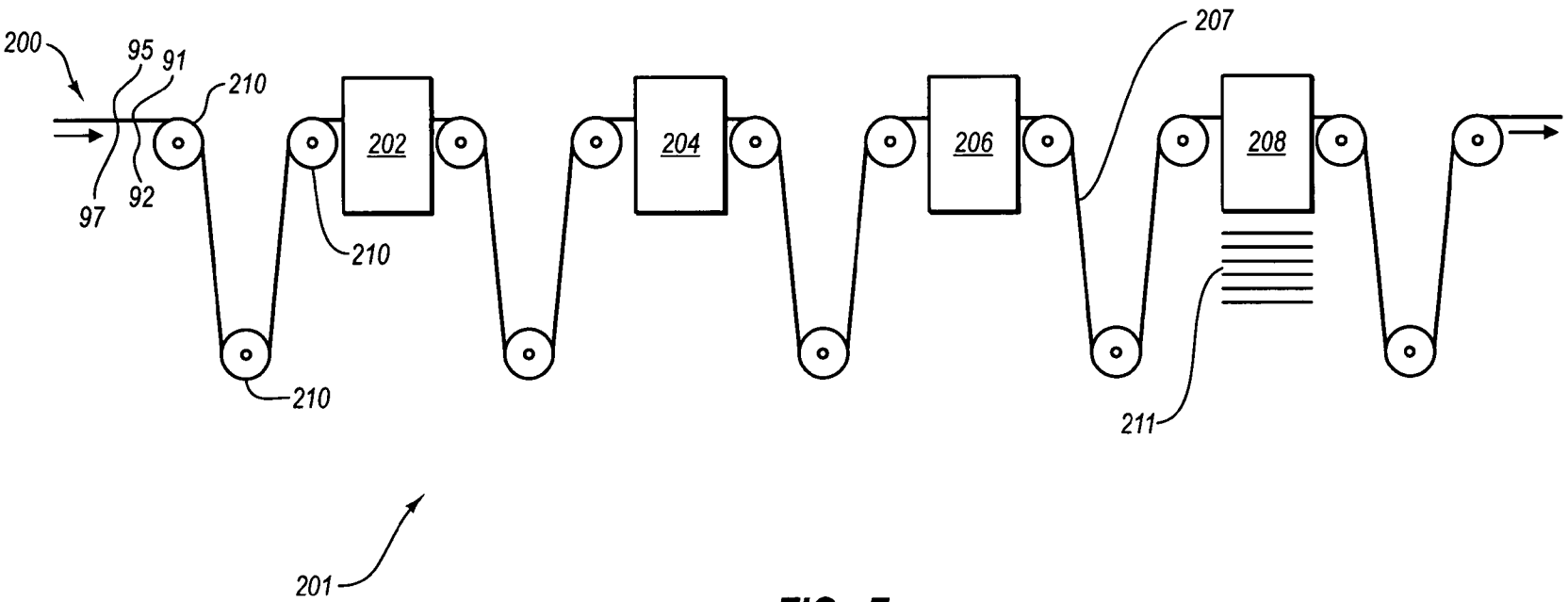
FIG. 7 depicts a cross sectional view of an apparatus for preparing one embodiment of the luggage tags of the present invention from pre-prepared stock.

Referring now to FIG. 7, one embodiment of a process for applying the scratch surface 64 and performing the kiss-cutting and additional cutting operations to a substrate is disclosed. Specifically, a continuous feed of flexible vinyl substrate 200 similar to the two-layer substrate described above is fed to a processing apparatus 201. The processing apparatus 201 comprises a clear ultraviolet coating applicator 202, a grey ultraviolet coating applicator 204, a kiss-cutting device 206 and a die cutting device 208. In one embodiment, the flexible vinyl substrate 200 has previously undergone lithographic processing and has imprinted thereon a series of luggage tags having one or more of the various segments of printed information described above applied to the topside 95 of the first layer 91 and the topside 97 of the second layer 92. The substrate 200 then passes through the clear ultraviolet coating applicator 202 where a clear ultraviolet coating 64B is applied to a suitable space of the second portion 60 as described and illustrated above—see, e.g., FIGS. 3 and 6. Following application of the clear ultraviolet layer 64B, the substrate 200 then passes through the grey ultraviolet coating applicator 204 where a grey ultraviolet coating 64A is applied to the suitable space of the second portion 60 as described and illustrated above. In an alternative embodiment, only one applicator is employed to apply only the grey ultraviolet coating.

Following application of the grey ultraviolet coating or both the clear and grey ultraviolet coatings, the substrate 200 then passes through the kiss-cutting device 206, where both layers of the substrate 200 are kiss-cut in the positions indicated in, for example, FIG. 6, including the perforated segment 62. The kiss-cutting operation leaves the substrate 200 and the layers 91, 92 comprising the substrate still intact. At this point, the kiss-cut substrate 207 passes through a die-cutting device 208. The die-cutting device 208 is configured to cut through both layers 91, 92 of the substrate 200 in a pattern that yields the final luggage tag 50 product, as illustrated, for example, in FIGS. 3 and 4. As the substrate passes through the die-cutting apparatus 208 and is die-cut, the cut luggage tags 50 are collectably received in a manner known by those having skill in the art—e.g., in a stack 211 adjacent the die-cutting device 208. The remainder of the substrate 200 is then passed to a collecting device—e.g., a roll (not illustrated)—where the remainder is collected for disposal.

Those having skill in the art will appreciate that the above described process may occur in "single row-series," where a single row of luggage tags 50 is imprinted on the substrate 200 and processed with the ultraviolet layer(s), kiss-cut and then die-cut, or in "parallel row-series," where parallel rows of luggage tags 50 are imprinted on the substrate 200 processed with the ultraviolet layer(s), kiss-cut and then die-cut.

Figure 8:
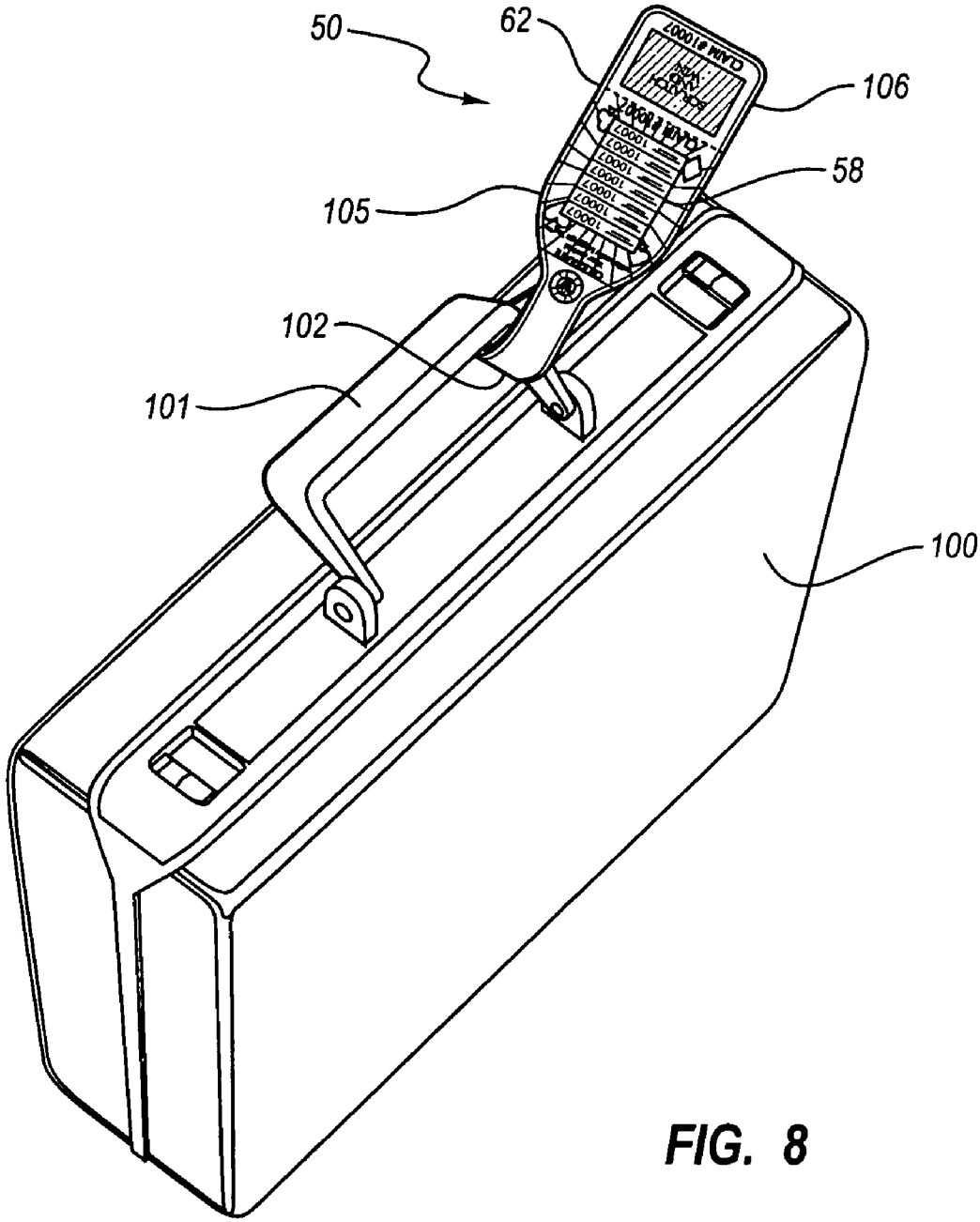
FIG. 8 depicts a perspective view of the embodiment disclosed in FIGS. 3 and 4 shown attached to a luggage case.

In one embodiment of use, a method for identifying ownership of luggage and providing a promotional advertisement is disclosed. Referring, for example, to FIGS. 3, 4 and 8, upon arrival by a guest at a hotel or casino, a luggage tag 50 of the present invention is obtained by a hotel or casino employee. Information concerning the name of the guest and the number of pieces of luggage is noted on the second portion 67 of the second surface 54 of the luggage tag 50, along with the room number or cell phone number or other pertinent identifying information of the guest or the identification number of the employee. The first 82 and second 83 removable portions are removed from the second layer 92 thereby exposing corresponding portions of the adhesive underside 94 of the first layer 91. Referring now to FIG. 7, the luggage tag 50 is then looped through a handle 101 or strap of a luggage piece 100 followed by the now exposed corresponding portions of the adhesive underside 94 being secured to one another, thereby forming a loop 102 preventing removal of the luggage tag 50 from the luggage piece 100. Luggage identifying labels 58 are then detached from the first layer 91 of the luggage tag 50 and secured using the adhesive underside 94 to the handles or other suitable locations of any other individual pieces of luggage. Each piece of luggage is thus uniquely identified for transport to the guest's room by a bellhop or other hotel or casino employee.

Following the securing of the luggage tag 50 and labels 58 to the guest's luggage pieces, the luggage tag 50 is separated into a first tag portion 105 and a second tag portion 106 by tearing the perforation segment 62 that extends through both the first 91 and second 92 layers of the luggage tag 50. The first tag portion 105 remains secured to the luggage piece 100 while the second tag portion 106 is handed to the owner of the luggage piece 100. The owner may then, at his or her convenience, remove the scratch surface 64, thereby revealing a prize—e.g., a ticket or tickets to a show or dinner at a restaurant—or other promotional item.

While certain embodiments and details have been included herein and in the attached invention disclosure for purposes of illustrating the invention, it will be apparent to those skilled in the art that various changes in the methods and apparatuses disclosed herein may be made without departing form the scope of the invention, which is defined in the appended claims.

What is claimed is:

1. A luggage tag for identifying luggage and providing promotional material, comprising:

a substrate having a first layer and a second layer in adhesive contact with the first layer, the substrate having a first end and a second end spaced from the first end;

the first layer having a first underside and a first topside surface, said first topside surface having a first scratch surface portion covering promotional material, said first scratch surface portion positioned proximate to said second end, the first topside surface further having a number of selectively removable identifying labels which, when detached from the luggage tag, are secured to individual pieces of luggage by an adhesive underside; and the second layer having a second underside and a second topside surface, said second topside surface having a first portion for printing identifying information, said first portion for printing identifying information positioned proximate said second end, the second layer further having a first removable portion adjacent the first end and a second removable portion spaced from said first removable portion, said first and second removable portions being separated by an interior portion of the second layer, wherein when removed, the first underside of said first layer is exposed in which exposed portions of the first underside are configured and spaced to adhesively contact one another to form an attachment loop; and said first topside surface further comprising a second scratch surface portion covering promotional material, said second scratch surface portion positioned on said first substrate portion, wherein, after the first and second scratch surfaces are removed, matching first and second printed promotional advertisements is indicative of a prize being won.

2. The luggage tag of claim 1, wherein the first scratch surface portion and the first portion for printing identifying information are removable from the substrate, thereby dividing the substrate into a first substrate portion and a second substrate portion.

3. The luggage tag of claim 2, further comprising a perforated segment, wherein the first scratch surface portion and the first portion for printing identifying information are removable as a unit from the substrate thereby dividing the substrate into a first substrate portion and a second substrate portion.

4. The luggage tag of claim 3, wherein the first topside surface includes at least one identifying label on each of the first substrate portion and the second substrate portion.

5. The luggage tag of claim 4, wherein the identifying labels include identifying characteristics that are alphanumeric characters.

6. The luggage tag of claim 1, wherein said first layer includes a vinyl sheet, wherein said first underside includes an adhesive material and wherein said first topside surface is suitable for lithographic printing.

7. The luggage tag of claim 6, wherein said second layer includes a vinyl sheet, wherein said second underside includes an adhesive receiving material and wherein said second topside surface is suitable for lithographic printing.

8. The luggage tag of claim 7, further comprising a perforated segment, wherein the first scratch surface portion and the first portion for printing identifying information are adhesively coupled and removable as a unit from the substrate, thereby dividing the substrate into a first substrate portion and a second substrate portion.

9. A luggage tag for identifying luggage and providing promotional material, comprising:

a substrate having a first layer and a second layer in adhesive contact with the first layer, the substrate having a first end and a second end spaced from the first end, the substrate having a perforated segment positioned intermediate to the first and second ends permitting the substrate to be separated into a first substrate portion and a second substrate portion, said second substrate portion including the second end of the substrate;

the first layer having a first underside and a first topside surface, said first topside surface having a first scratch surface portion covering promotional material, said first scratch surface portion positioned on said second substrate portion, the first topside surface further having a second scratch surface portion covering promotional material, said second scratch surface portion positioned on said first substrate portion, wherein, after the first and second scratch surfaces are removed, matching first and second printed promotional advertisements is indicative of a prize being won;

said first topside surface further including at least one identifying label positioned on each of the first substrate portion and the second substrate portion;

the second layer having a second underside and a second topside surface, said second topside surface having a first portion for printing identifying information, said first portion for printing identifying information positioned on said second substrate portion, said second layer including a second portion of said second topside surface for printing identifying information, said second portion positioned on said first substrate portion;

the second layer further having a removable portion adjacent the first end, so that when removed, the first end is configured to adhesively contact a portion of the second layer intermediate the first and second ends to form an attachment loop.

10. The luggage tag of claim 9, wherein said first layer includes a vinyl sheet, wherein said first underside includes adhesive material and wherein said first topside surface is suitable for lithographic printing.

11. The luggage tag of claim 10, wherein said second layer includes a vinyl sheet, wherein said second underside includes an adhesive receiving material and wherein said second topside surface is suitable for lithographic printing.

12. A luggage tag comprising:

a substrate having a first layer and a second layer;

the first layer comprising a vinyl sheet having a first surface and a second surface, the second surface having an adhesive for adhering the first layer to the second layer, the first surface of the first layer comprising:

a number of selectively removable identifying labels which, when detached from the luggage tag, are secured to individual pieces of luggage by an adhesive underside on the identifying labels;

the second layer comprising a vinyl sheet having a first surface and a second surface, the first surface configured to receive the adhesive of the first layer, the second surface of the second layer comprising:

a first removable portion and a second removable portion spaced from said first removable portion, said first and second removable portions being separated by an interior portion of the second layer, wherein when removed, the second surface of said first layer is exposed in which exposed portions of the second surface of the first layer are configured and spaced to adhesively contact one another to form an attachment loop;

in which the first and second layer comprise a perforated segment which, when torn, permits the separation of the substrate into a first substrate portion and a second substrate portion;

wherein the first surface of the first layer of the first substrate portion comprises:

a first printed portion for printing ownership identifying information;

a first identification serial number;

a first barcode; and a first scratch surface covering a first printed promotional advertisement, in which the first scratch surface may be scratched away by a user to expose the first printed promotional advertisement;

wherein the first surface of the first layer of the second substrate portion comprises:

a second identification serial number corresponding to the first identification serial number; and a second scratch surface covering a second printed promotional advertisement, in which the second scratch surface may be scratched away by a user to expose the second printed promotional advertisement;

wherein the second surface of the second layer of the first substrate portion comprises:

a second portion for printing ownership identifying information; and a first printed disclaimer relating to the first and second printed promotional advertisements;

wherein the second surface of the second layer of the second substrate portion comprises:

a second printed disclaimer relating to the first and second printed promotional advertisements; and a second barcode corresponding to the first barcode;

wherein, matching first and second printed promotional advertisements is indicative of a prize being won.

* * * * *